US010803811B2

(12) United States Patent
Wang et al.

(10) Patent No.: US 10,803,811 B2
(45) Date of Patent: Oct. 13, 2020

(54) DISPLAY APPARATUS, DRIVER FOR DRIVING DISPLAY PANEL AND SOURCE DRIVING SIGNAL GENERATION METHOD

(71) Applicant: BOE TECHNOLOGY GROUP CO., LTD., Beijing (CN)

(72) Inventors: Lirong Wang, Beijing (CN); Fei Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/554,034

(22) Filed: Aug. 28, 2019

(65) Prior Publication Data

US 2020/0074935 A1 Mar. 5, 2020

(30) Foreign Application Priority Data

Aug. 31, 2018 (CN) ..... 2018 1 1010878

(51) Int. Cl.
*G09G 3/3275* (2016.01)

(52) U.S. Cl.
CPC ..... *G09G 3/3275* (2013.01); *G09G 2310/08* (2013.01)

(58) Field of Classification Search
None
See application file for complete search history.

(56) References Cited

U.S. PATENT DOCUMENTS

2011/0037758 A1* 2/2011 Lim ..... H03L 7/0805 345/213
2016/0125840 A1* 5/2016 Oh, Il ..... G09G 5/008 345/213
2016/0189595 A1* 6/2016 Choi ..... G09G 3/2074 345/212

* cited by examiner

*Primary Examiner* — Dorothy Harris
(74) *Attorney, Agent, or Firm* — Nath, Goldberg & Meyer; Joshua B. Goldberg

(57) ABSTRACT

The present application provides a driver for driving a display panel. The driver includes a timing controller, and N cascaded source drivers, N being an integer equal to or larger than 2. The N source drivers are configured to receive sensing signals obtained by detecting characteristics of pixel units in the display panel, respectively. An n-th source driver of the N source drivers is configured to transmit the sensing signal received by the n-th source driver to the timing controller through all source drivers of the N source drivers after the n-th source driver as a signal transmission channel, where 1≤n<N and n is an integer. The present application further provides a display apparatus and a method for generating a source driving signal.

15 Claims, 3 Drawing Sheets

DISPLAY APPARATUS, DRIVER FOR DRIVING DISPLAY PANEL AND SOURCE DRIVING SIGNAL GENERATION METHOD

CROSS-REFERENCE TO RELATED APPLICATION

This application claims priority to Chinese Patent Application No. 201811010878.8, filed on Aug. 31, 2018, the entire contents of which are hereby incorporated by reference.

TECHNICAL FIELD

The present disclosure relates to the field of display technology, and particularly, to a display apparatus, a driver of the display apparatus for driving a display panel and a method for generating a source driving signal using the driver.

BACKGROUND

The display apparatus may age with use, and the display performance thereof may be degraded if the display signal therefor is not compensated.

For this reason, a detection circuit for external compensation may be provided within the display apparatus. The detection circuit may perform a detection on the display apparatus at a preset interval, generate a compensation data signal based on the result of the detection, and provide the compensation data signal to a timing controller of the display apparatus.

The timing controller may combine the compensation data signal and a data signal provided from an external signal source to re-generate a display signal for driving the display apparatus to display.

SUMMARY

In an aspect, the present disclosure provides a driver for driving a display panel, including a timing controller, and N source drivers that are cascaded, N being an integer equal to or larger than 2, wherein the N source drivers are configured to receive sensing signals obtained by detecting characteristics of pixel units in the display panel, respectively, and wherein an n-th source driver of the N source drivers is configured to transmit the sensing signal received by the n-th source driver to the timing controller through all source drivers of the N source drivers after the n-th source driver as a signal transmission channel, where $1 \leq n < N$ and n is an integer.

In some embodiments, the timing controller includes a display signal input terminal, a first sensing signal input terminal and a display data output terminal; the timing controller is configured to generate an initial display driving signal based on a display signal received through the display signal input terminal and a sensing signal received through the first sensing signal input terminal, and output the initial display driving signal through the display data output terminal; the source driver includes an initial display driving signal input terminal, a sensing signal output terminal, a second sensing signal input terminal, a third sensing signal input terminal and a source driving signal output terminal; the third sensing signal input terminal is configured to receive a sensing signal provided from a detection circuit corresponding to the source driver; and the N source drivers sequentially transmit the sensing signals received by the N source drivers to the first sensing signal input terminal of the timing controller, and wherein the N source drivers are cascaded by coupling the sensing signal output terminal of the n-th source driver to the second sensing signal input terminal of the (n+1)-th source driver, and electrically coupling the sensing signal output terminal of a last one of the N source drivers to the first sensing signal input terminal of the timing controller.

In some embodiments, the source driver includes a source driving sub-circuit, a digital-to-analog conversion sub-circuit and an analog-to-digital conversion sub-circuit, an input terminal of the source driving sub-circuit is configured as the initial display driving signal input terminal of the source driver, and a first output terminal of the source driving sub-circuit is electrically coupled to an input terminal of the digital-to-analog conversion sub-circuit; the source driving sub-circuit is configured to convert a received initial display driving signal into a source driving signal in digital form and output the source driving signal in digital form through the first output terminal of the source driving sub-circuit to the digital-to-analog conversion sub-circuit; an output terminal of the digital-to-analog conversion sub-circuit is configured as the source driving signal output terminal of the source driver, and the digital-to-analog conversion sub-circuit is configured to convert the received source driving signal in digital form into a source driving signal in analog form and output the source driving signal in analog form; an input terminal of the analog-to-digital conversion sub-circuit is configured as the third sensing signal input terminal of the source driver, and an output terminal of the analog-to-digital conversion sub-circuit is configured as the sensing signal output terminal of the source driver; the analog-to-digital conversion sub-circuit is configured to convert a received sensing signal in analog form into a sensing signal in digital form and output the sensing signal in digital form in a first predetermined timing.

In some embodiments, the source driver further includes a clock sub-circuit, the timing controller further includes a clock signal output terminal, and the timing controller is further configured to sequentially output clock control signals to the clock sub-circuits of the N source drivers in a second predetermined timing; an input terminal of the clock sub-circuit is electrically coupled to the clock signal output terminal of the timing controller, and an output terminal of the clock sub-circuit is coupled to a control terminal of the analog-to-digital conversion sub-circuit belonging to the same source driver as the clock sub-circuit; the clock sub-circuit is configured to output, upon receipt of a clock control signal from the timing controller, a clock signal to the control terminal of the analog-to-digital conversion sub-circuit belonging to the same source driver as the clock sub-circuit; and the analog-to-digital conversion sub-circuit is configured to output the sensing digital form based on the received clock signal.

In some embodiments, the source driver further includes a clock sub-circuit, the timing controller further includes a clock input terminal, the source driving sub-circuit is further configured to generate a timing control signal, and output, through a second output terminal of the source driving sub-circuit, the timing control signal to a first input terminal of the clock sub-circuit belonging to the same source driver as the source driving sub-circuit and a control terminal of the analog-to-digital conversion sub-circuit belonging to the same source driver as the source driving sub-circuit, respectively; and the clock sub-circuit is configured to generate a clock signal based on the timing control signal; the analog-to-digital conversion sub-circuit is configured to output the sensing signal in digital form upon receipt of the timing control signal; wherein the N source drivers are cascaded by electrically coupling an output terminal of the clock sub-circuit of the n-th source driver to a second input terminal of the clock sub-circuit of the (n+1)-th source driver, and electrically coupling an output terminal of the clock sub-circuit of the last one of the N source drivers to the clock input terminal of the timing controller, so as to sequentially transmit the clock signals of the N source drivers to the timing controller; and the timing controller is configured to transmit the initial display driving signal to a corresponding source driver upon receipt of the clock signal after a first frame of image is displayed.

In some embodiments, each of the clock control signal and the clock signal includes a plurality of pairs of differential signals.

In some embodiments, each of the timing control signal and the clock signal includes a plurality of pairs of differential signals.

In some embodiments, the sensing signal includes at least one pair of differential signals.

In another aspect, the present disclosure provides a display apparatus including a display panel and a driver, the display panel including a plurality of data lines and a plurality of detection circuits, wherein the driver is any one of the drivers described herein, and the plurality of detection circuits are in one-to-one correspondence with the plurality of source drivers, an output terminal of a detection circuit is electrically coupled to a third sensing signal input terminal of a corresponding one of the plurality of source drivers, and a source driving signal output terminal of the source driver is electrically coupled to a corresponding data line.

In another aspect, the present disclosure provides a method for generating a source driving signal using a driver, the driver being configured to drive a display panel and including a timing controller and N source drivers that are cascaded, N being an integer equal to or larger than 2, the method including: receiving, by the N source drivers, sensing signals obtained by detecting characteristics of pixel units in the display panel, respectively; and transmitting the received sensing signals to the timing controller, respectively, wherein an n-th source driver of the N source drivers is configured to transmit the sensing signal received by the n-th source driver to the timing controller through all source drivers of the N source drivers after the nth source driver as a signal transmission channel, where $1 \leq n < N$ and n is an integer.

In some embodiments, the method further includes: generating, by the timing controller, an initial display driving signal based on a display signal and a sensing signal received by the timing controller, and outputting the initial display driving signal to a source driver from which the sensing signal is transmitted; and generating, by the source driver, a source driving signal based on the initial display driving signal received by the source driver.

In some embodiments, the transmitting the received sensing signals to the timing controller, respectively includes: outputting, by the timing controller, clock control signals to the N source drivers sequentially in a predetermined timing, such that the n-th source driver of the N source drivers, which receives the clock control signal, transmits the received sensing signal to the timing controller according to the predetermined timing.

In some embodiments, the method further includes: controlling the n-th source driver to transmit a clock signal generated by the n-th source driver to the timing controller through all source drivers of the N source drivers after the n-th source driver as a signal transmission channel; and transmitting, by the timing controller after receiving the clock signal, an initial display driving signal to the n-th source driver.

In some embodiments, the method further includes: controlling a last one of the N source drivers to transmit the received sensing signal directly to the timing controller according to the predetermined timing.

In some embodiments, the method further includes: controlling a last one of the N source drivers to transmit a dock signal generated by the last one of the N source drivers directly to the timing controller.

BRIEF DESCRIPTION OF THE DRAWINGS

The drawings are provided for further understanding of the present disclosure, constitute part of this specification, and serve to explain the present disclosure together with the following embodiments, but are not intended to limit the present disclosure, in which.

DETAILED DESCRIPTION

Hereinafter, the embodiments of the present disclosure will be described in details. It should be understood that the embodiments described herein are merely for illustrating and explaining the present disclosure, rather than limiting the present disclosure.

A timing controller (e.g., timing controller IC) may combine the compensation data signal and a data signal provided from an external signal source to re-generate a display signal for driving the display apparatus to display. However, this may result in that the timing controller has disadvantages such as complex structure and high power consumption.

Accordingly, the present disclosure provides, inter alia, a display apparatus, a driver of the display apparatus for driving a display panel and a method for generating a source driving signal using the driver that substantially obviate one or more of the problems due to limitations and disadvantages of the related art. According to an embodiment of the present disclosure, the structure of the timing controller can be simplified and the power consumption can be lowered, while the compensation can he achieved.

In an aspect, the present disclosure provides a driver for driving a display panel. The driver may include a timing controller and N cascaded source drivers, N is an integer equal to or larger than 2, wherein the N source drivers are configured to receive sensing signals obtained by detecting characteristics of pixel units in the display panel, respectively, and wherein an n-th source driver of the N source drivers is configured to transmit the sensing signal received by the n-th source driver to the timing controller through all source drivers of the N source drivers after the n-th source driver as a signal transmission channel, where $1 \leq n < N$ and n is an integer.

Figure 1:
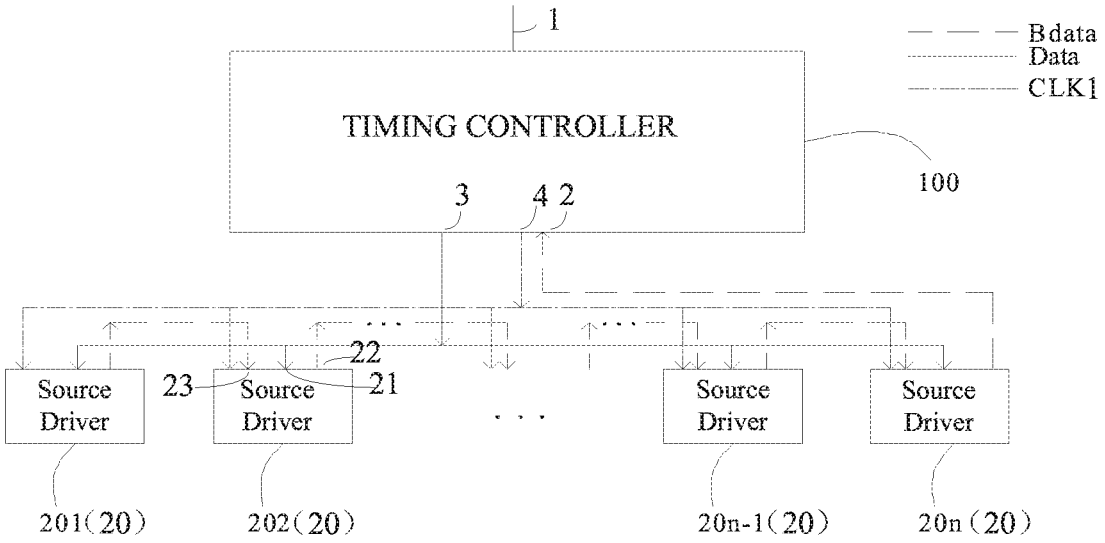
FIG. 1 is a schematic diagram illustrating a driver in some embodiments of the present disclosure.
Figure 2:
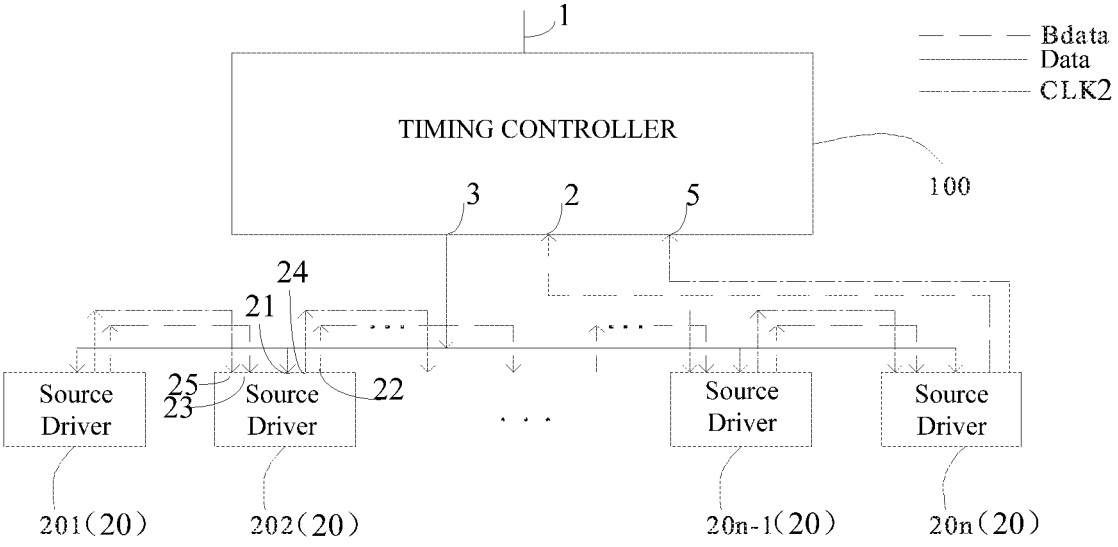
FIG. 2 is another schematic diagram illustrating a driver in some embodiments of the present disclosure.

FIG. 1 is a schematic diagram illustrating a driver in some embodiments of the present disclosure. FIG. 2 is another schematic diagram illustrating a driver in some embodiments of the present disclosure. As illustrated in FIGS. 1 and 2, the driver may include a timing controller 100 and a plurality of (e.g., N) source drivers 20. In an embodiment, the source driver 20 may be a source driver IC (integrated circuit). The timing controller 100 may include a display signal input terminal 1, a first sensing signal input terminal 2 and a display data output terminal 3. The timing controller 100 is capable of generating an initial display driving signal based on a display signal received by the display signal input terminal 1 and a sensing signal received by the first sensing signal input terminal 2, and output the initial display driving signal through the display data output terminal 3.

The display signal received by the display signal input terminal 1 is a signal (e.g., video signal or picture signal) provided from a signal source (e.g., video signal source or picture source). After receiving the display signal, the timing controller 100 may generate a display driving signal for driving the display apparatus to display a corresponding video or picture.

The source driver 20 may include an initial display driving signal input terminal 21, a sensing signal output terminal 22, a second sensing signal input terminal 23, a third sensing signal input terminal and a source driving signal output terminal, which will be described later. The third sensing signal input terminal is configured to receive a sensing signal provided from a detection circuit (which will be described later) corresponding to the source driver 20.

As illustrated in FIGS. 1 and 2, the plurality of source drivers 20 are cascaded to sequentially transmit the sensing signals received by the source drivers 20 to the first sensing signal input terminal 2 of the timing controller 100. The plurality of stages of the source drivers 20 may be cascaded in the following manner: the sensing signal output terminal 22 of a current stage of source driver 20 is coupled to the second sensing signal input terminal 23 of a next stage of source driver 20, and the sensing signal output terminal 22 of the last stage of source driver 20 is electrically coupled to the first sensing signal input terminal 2.

In the embodiments illustrated in FIGS. 1 and 2, the plurality of source drivers 20 is exemplarily illustrated to include a first stage of source driver 201, a second stage of source driver 202, . . . , a (n−1)-th stage of source driver 20*n*−1 and an n-th stage of source driver 20*n*, but the present disclosure is not limited thereto. Moreover, in FIGS. 1 and 2, the dashed line denotes a signal flow of the sensing signal Bdata, the solid line denotes a signal flow of the initial display driving signal Data, and the dot-and-dash line denotes a signal flow of a clock control signal CLK1 (in FIG. 1) or a clock signal CLK2 (in FIG. 2), which will be described in detail later.

In the driver provided by the present disclosure, the plurality of stages of source drivers are cascaded, and the second sensing signal input terminal and the sensing signal output terminal respectively from adjacent two stages of source drivers are electrically coupled to form a signal transmission channel. The timing controller 100 can receive the sensing signals from the plurality of stages of source drivers 20, sequentially.

In an embodiment, a sensing signal received through the third sensing signal input terminal of the first stage of source driver 201 is transmitted by the first stage of source driver 201 through the sensing signal output terminal 22 of the first stage of source driver 201 to the second sensing signal input terminal 23 of the second stage of source driver 202, then transmitted from the sensing signal output terminal 22 of the second stage of source driver 202 to the second sensing signal input terminal 23 of the third stage of source driver, and so on, and finally transmitted from the sensing signal output terminal 22 of the n-th stage of source driver 20*n* to the first sensing signal input terminal 2 of the timing controller 100.

After the sensing signal is transmitted from the first stage of source driver 201 to the timing controller 100, a sensing signal received through the third sensing signal input terminal of the second stage of source driver 202 is transmitted by the second stage of source driver 202 to the sensing signal output terminal 22 of the second stage of source driver 202, and then transmitted from the sensing signal output terminal 22 of the second stage of source driver 202 to the second sensing signal input terminal 23 of the third stage of source driver, and so on, until the sensing signal received by the second stage of source driver 202 is transmitted to the first sensing signal input terminal 2 of the timing controller 100.

Likewise, a sensing signal received through the third sensing signal input terminal of the n-th stage of source driver 20*n* is transmitted by the n-th stage of source driver 20*n* to the signal output terminal 22 of the n-th stage of source driver 20*n*, and then transmitted from the signal output terminal 22 of the n-th stage of source driver 20*n* to the first sensing signal input terminal 2 of the timing controller 100. As such, the first sensing signal input terminal 2 of the timing controller 100 can receive the sensing signal from the n-th stage of source driver 20*n*.

In an embodiment, the second sensing signal input terminal 23 of the source driver 20 configured to receive a sensing signal may have a bypass function. The sensing signal is directly transmitted to a next stage of source driver 20 upon receipt of the sensing signal.

The timing controller 100 in the driver provided by the present disclosure can receive the sensing signals from n stages of source drivers sequentially through only one first sensing signal input terminal 2, thereby reducing the number of pins of the timing controller 100, reducing cost of the timing controller 100 and reducing the total cost of the driver.

After receiving the sensing signal transmitted from the first stage of source driver 201, the timing controller 100 may compensate the display signal based on the received sensing signal, generate an initial display driving signal Data corresponding to the first stage of source driver 201, and transmit the initial display driving signal Data to the initial display driving signal input terminal 21 of the first stage of source driver 201. The first stage of source driver 201 may convert the initial display driving signal to a source driving signal (which is in analog form) and output the same from its source driving signal output terminal. In the present disclosure, the source driving signal output terminal is configured to be coupled with a data line of the display panel. The pixel unit in a corresponding portion of the display panel is driven to emit light by the source driving signal received by the data line in combination with the gate driving signal.

In the present disclosure, each source driver 20 may include a plurality of source driving signal output terminals, and each of the plurality of source driving signal output terminals corresponds to one data line, such that the driver can provide source driving signals for all data lines in the display panel.

In the present disclosure, a clock signal needs to be utilized to control timing of transmitting the sensing signal by the source drivers 20.

In the embodiment illustrated in FIG. 1, a clock control signal CLK1 is generated by the timing controller 100, and in the embodiment illustrated in FIG. 2, a timing control signal is generated by the source driver 20, which will be described later.

In the present disclosure, the specific structure of the source driver 20 is not particularly limited, as long as it can convert the initial display driving signal from the timing controller 100 to a source driving signal.

Figure 3:
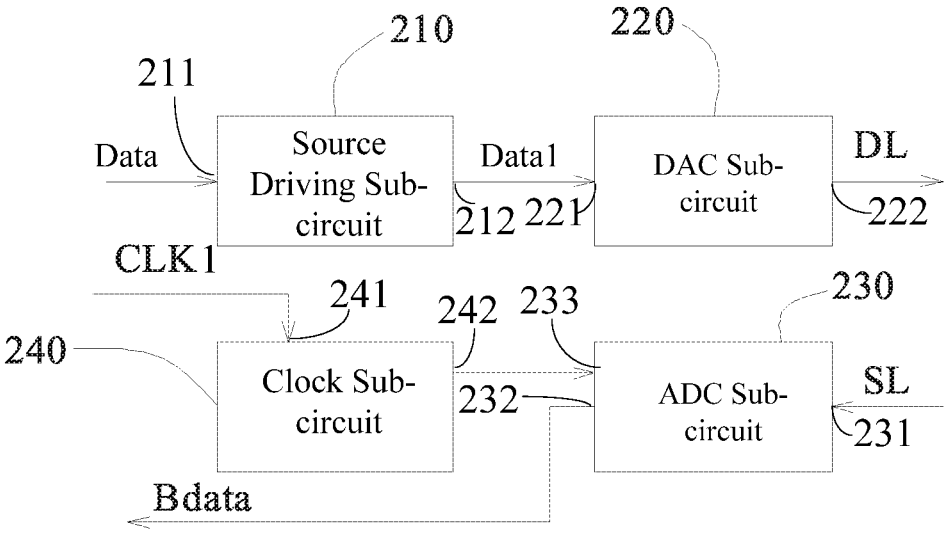
FIG. 3 is a schematic diagram of a source driver in the driver of FIG. 1.
Figure 4:
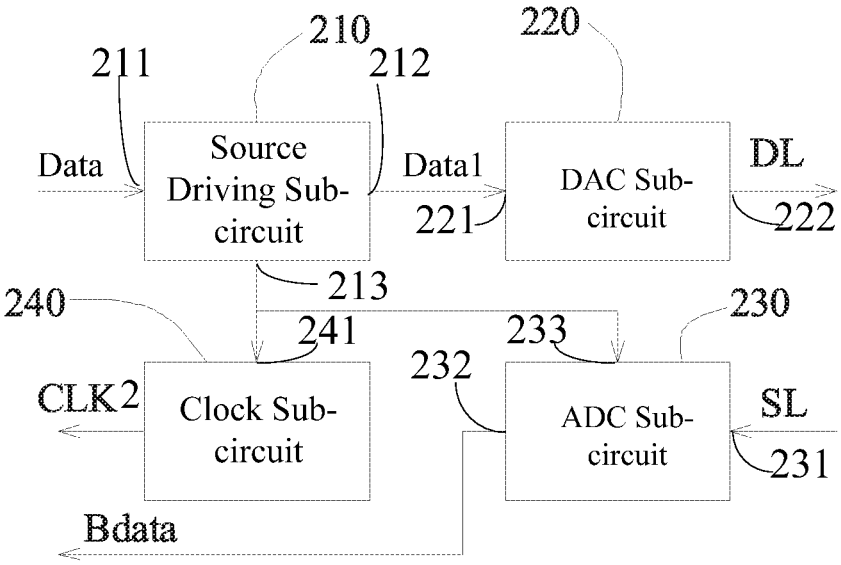
FIG. 4 is a schematic diagram of a source driver in the driver of FIG. 2.

FIG. 3 is a schematic diagram of a source driver in the driver of FIG. 1. FIG. 4 is a schematic diagram of a source driver in the driver of FIG. 2. As illustrated in FIGS. 3 and 4, the source driver 20 may include a source driving sub-circuit 210, a digital-to-analog conversion (DAC) sub-circuit 220 and an analog-to-digital conversion (ADC) sub-circuit 230.

An input terminal 211 of the source driving sub-circuit 210 is formed to be the initial display driving signal input terminal of the source driver 20, and a first output terminal 212 of the source driving sub-circuit 210 is electrically coupled to an input terminal 221 of the digital-to-analog conversion sub-circuit 220. The source driving sub-circuit 210 is configured to convert a received initial display driving signal Data into a source driving signal Data 1 in digital form and transmit the same through the first output terminal 212 of the source driving sub-circuit 210 to the digital-to-analog conversion sub-circuit 220.

An output terminal 222 of the digital-to-analog conversion sub-circuit 220 is formed to be the source driving signal output ten nal of the source driver 20, and the digital-to-analog conversion sub-circuit 220 is configured to convert the received source driving signal in digital form into a source driving signal in analog form and output the source driving signal in analog form.

An input terminal 231 of the analog-to-digital conversion sub-circuit 230 is formed to be the third sensing signal input terminal of the source driver 20, and an output terminal 232 of the analog-to-digital conversion sub-circuit 230 is formed to be the sensing signal output terminal of the source driver 20. The analog-to-digital conversion sub-circuit 230 is configured to convert a received sensing signal in analog form into a sensing signal in digital form and output the sensing signal in digital form in a first predetermined timing.

It should be noted that the output terminal 222 of the digital-to-analog conversion sub-circuit 220 is coupled to a data line DL, and the data line DL drives a corresponding pixel unit to emit light based on the received source driving signal in analog form. The input terminal 231 of the analog-to-digital conversion sub-circuit 230 is electrically coupled to a sensing signal line SL, and a signal received from a detection circuit coupled to the sensing signal line SL is an analog signal. The analog-to-digital conversion sub-circuit 230 can convert the analog signal into a sensing signal Bdata in digital form capable of being processed by the timing controller 100.

In the present disclosure, there is no particular limitation on how to control each stage of source driver 20 to output the sensing signal Bdata.

In the embodiments illustrated in FIGS. 1 and 3, the timing of outputting the sensing signals from the plurality of stages of source drivers 20 is controlled by the timing controller 100. In an embodiment, the source driver 20 may further include a clock sub-circuit 240, and the timing controller 100 may further include a dock signal output terminal 4. Accordingly, the timing controller 100 is further configured to output clock control signals CLK1 to the clock sub-circuits 240 of the plurality of stages of source drivers 20 sequentially in a second predetermined timing. In an embodiment, the first predetermined timing is the same as the second predetermined An input terminal 241 of the clock sub-circuit 240 is electrically coupled to the clock signal output terminal 4 of the timing controller 100, and an output terminal 242 of the clock sub-circuit 240 is coupled to a control terminal 233 of the analog-to-digital conversion sub-circuit 230 belonging to the same source driver 20 as the clock sub-circuit 240. The clock sub-circuit 240 is configured to output a clock signal to the control terminal 233 of the analog-to-digital conversion sub-circuit 230 after receiving the clock control signal CLK1 from the timing controller 100. The analog-to-digital conversion sub-circuit 230 is configured to output the converted sensing signal in digital form based on the received clock signal.

In an embodiment, the timing controller 100 transmits the clock control signals CLK1 to the plurality of stages of source drivers 20, and the clock control signals CLK1 include timing of transmitting the sensing signals by the analog-to-digital conversion sub-circuits 230 of the plurality of stages of source drivers 20.

In a display phase of a display apparatus having the driver of FIG. 1, the timing controller 100 transmits initial display driving signals to the plurality of stages of source drivers 20, which convert the initial display driving signals into source driving signals in analog form and output the same to respective data lines to drive, in cooperation with the gate driver, the display panel of the display apparatus to display various pictures.

In a detection phase, the timing controller 100 transmits the clock control signals CLKI to all source drivers 20 in the second predetermined timing. After receiving the clock control signal CLK1, the first stage of source driver 201 transmits the sensing signal Bdata to the second stage of source driver 202, and the second stage of source driver 202 to the n-th stage of source driver 20*n* can function as a channel for transmitting the sensing signal Bdata of the first stage of source driver 201, until the n-th stage of source driver 20*n* transmits the sensing signal Bdata of the first stage of source driver 201 to the timing controller 100.

Then, after receiving the clock control signal CLK1, the second stage of source driver 202 transmits the sensing signal Bdata to the third stage of source driver, and the third stage of source driver to the n-th stage of source driver 20*n* can function as a channel for transmitting the sensing signal Bdata of the second stage of source driver 202, until the n-th stage of source driver 20*n* transmits the sensing signal Bdata of the second stage of source driver 202 to the timing controller 100.

Likewise, after receiving the clock control signal CLK1, the n-th stage of source driver 20*n* may transmit the sensing data Bdata of the n-th stage of source driver 20*n* to the timing controller 100.

In the embodiments illustrated in FIGS. 2 and 4, the plurality of stages of source drivers 20 may be utilized to achieve control of timing of outputting sensing signals. In an embodiment, the source driver 20 may include a clock sub-circuit 240, and the source driving sub-circuit 210 is further configured to generate a timing control signal, and output the timing control signal to the input terminal 241 of the clock sub-circuit 240 and the control terminal 233 of the analog-to-digital conversion sub-circuit 230, respectively, through a second output terminal 213 of the source driving sub-circuit 210.

The analog-to-digital conversion sub-circuit 230 is configured to output the converted sensing signal in digital form after receiving the timing control signal, and the clock sub-circuit 240 is configured to generate a clock signal CLK2 based on the timing control signal and transmit the clock signal CLK2 to the timing controller 100.

After a first frame of image is displayed, the timing controller 100 is configured to transmit the initial display driving signal to the source driver, from which the clock signal is transmitted, upon receipt of the clock signal.

In the present disclosure, the clock signal may be transmitted to the timing controller 100 by electrically coupling an output terminal 24 of the clock sub-circuit of a current stage of source driver to an input terminal 25 of the clock sub-circuit of a next stage of source driver and electrically coupling an output terminal 24 of the clock sub-circuit of a last stage of source driver to a clock signal input terminal 5 of the timing controller 100.

In the embodiments illustrated in FIGS. 2 and 4, not only the sensing signal but also the clock signal is transmitted in a cascaded manner.

In a display phase of a display apparatus having the driver of FIG. 2, the tinting controller 100 transmits initial display driving signals to the plurality of stages of source drivers 20, which convert the initial display driving signals into source driving signals (which are signals in analog form) and output the same to respective data lines to drive, in cooperation with the gate driver, the display panel of the display apparatus to display various pictures.

In a detection phase, the clock signal CL,K2 and the sensing signal Bdata are transmitted through adjacent source drivers, until the clock signal CLK2 and the sensing signal Bdata of the n-th stage of source driver are transmitted to the timing controller 100. After that, a next round of signal transmission starts.

In an embodiment, each of the clock control signal CLK1, the timing control signal and the clock signal includes a plurality of pairs of differential signals. The differential signal has a fast transmission speed, so that the efficiency of the driver can be improved.

In an embodiment, the sensing signal includes at least one pair of differential signals.

In another aspect, the present disclosure provides a display apparatus. The display apparatus includes a display panel and a driver, and the display panel includes a plurality of data lines and a plurality of detection circuits. The driver is one of the above drivers provided by the present disclosure, and the plurality of detection circuits are in one-to-one correspondence with the plurality of source drivers. An output terminal of the detection circuit is electrically coupled to the third sensing signal input terminal of a corresponding source driver, and the source driving signal output terminal of the source driver is electrically coupled to a corresponding data line.

As described above, the plurality of stages of source drivers in the driver transmit signals in a cascaded manner, thereby reducing the number of ports of the timing controller, reducing the cost of the timing controller and reducing the total cost of the driver.

Figure 5:
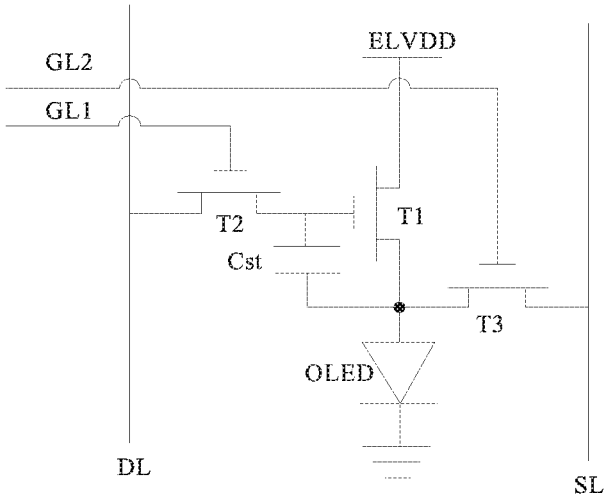
FIG. 5 is a circuit diagram of a detection circuit in some embodiments of the present disclosure.

Generally, the display panel includes a plurality of pixel units, each of which includes an organic light emitting diode and a pixel circuit. In an embodiment, as illustrated in FIG. 5, the pixel circuit may include a driving transistor T1, a switching transistor T2 and a storage capacitor Cst. A gate electrode of the switching transistor T2 is electrically coupled to a first gate line GL1, a first electrode of the switching transistor T2 is electrically coupled to a corresponding data line DL, and a second electrode of the switching transistor T2 is electrically coupled to a gate electrode of the driving transistor T1. A first electrode of the driving transistor T1 is electrically coupled to a high level signal terminal ELVDD and a second electrode of the driving transistor T1 is electrically coupled to an anode of an organic light emitting diode OLED. A cathode of the organic light emitting diode OLED is grounded.

To achieve the detection function, the display panel further includes a sensing signal line SL and each pixel unit includes a detection transistor T3. A gate electrode of the detection transistor T3 is electrically coupled to a second gate line GL2, a first electrode of the detection transistor T3 is electrically coupled to the anode of the organic light emitting diode OLED, and a second electrode of the detection transistor T3 is electrically coupled to the sensing signal line SL.

It could be easily understood that the timing controller 100 generates a display scanning signal and a detection scanning signal based on received display data. When the first gate line GLI receives an effective display scanning signal, the switching transistor T2 is turned on, and the source driving signal output from a respective source driver is written into the first electrode of the switching transistor T2 through the data line DL, and further written into the storage capacitor through the switching transistor T2. The organic light emitting diode OLED can be driven to emit light through the source driving signal.

The timing controller 100 may periodically generate the detection scanning signal, the detection transistor T3 is turned on after receiving the detection scanning signal transmitted through the second gate line GL2, and the characteristic (e.g., current characteristic) of the whole pixel circuit and the organic light emitting diode OLED may he detected through the sensing signal line SL.

In another aspect, the present disclosure provides a method for generating a source driving signal using any one of the above drivers. The method may include: receiving, by the N source drivers, sensing signals obtained by detecting characteristics of pixel units in the display panel, respectively; and transmitting the received sensing signals to the timing controller, respectively.

In an embodiment, an n-th source driver of the N source drivers is configured to transmit the sensing signal received by the n-th source driver to the timing controller through all source drivers of the N source drivers after the n-th source driver as a signal transmission channel, where $1 \leq n < N$ and n is an integer.

In an embodiment, the method may further include: generating, by the timing controller, an initial display driving signal based on a display signal and a sensing signal received by the timing controller, and outputting the initial display driving signal to a source driver from which the sensing signal is transmitted; and generating, by the source driver, a source driving signal based on the initial display driving signal received by the source driver.

In a case where the driver is the driver of FIG. 1, the step of transmitting the received sensing signals to the timing controller, respectively includes outputting, by the timing controller, clock control signals to the clock sub-circuits of the N source drivers sequentially in a second predetermined timing, such that the n-th source driver of the N source drivers, which receives the clock control signal, transmits according to the second predetermined timing the received sensing signal to the first sensing signal input terminal of the timing controller through all source drivers of the N source drivers after the n-th source driver as a signal transmission channel. In an embodiment, the method may further include: controlling a last one of the N source drivers to transmit according to the second predetermined timing the received sensing signal directly to the timing controller.

In a case where the driver is the driver of FIG. 2, the method may further include: controlling the n-th source driver to transmit a clock signal generated by the n-th source driver to the timing controller through all source drivers of the N source drivers after the nth source driver as a signal transmission channel; and transmitting, by the timing controller after receiving the clock signal, an initial display driving signal to the n-th source driver. In an embodiment, the method may further include: controlling a last one of the N source drivers to transmit a clock signal generated by the last one of the N source drivers directly to the timing controller.

It is to be understood that the above embodiments are merely exemplary embodiments employed to explain the principles of the present disclosure, but the present disclosure is not limited thereto. Various modifications and improvements can be made by those skilled in the art without departing from the spirit and scope of the disclosure, and such modifications and improvements are also considered to be within the scope of the disclosure.

What is claimed is:

1. A driver for driving a display panel, comprising a timing controller, and N source drivers that are cascaded, N being an integer equal to or larger than 2, wherein the N source drivers are configured to receive sensing signals obtained by detecting characteristics of pixel units in the display panel, respectively, and wherein an n-th source driver of the N source drivers is configured to transmit the sensing signal received by the n-th source driver to the timing controller through all source drivers of the N source drivers after the n-th source driver as a signal transmission channel, where $1 \leq n < N$ and n is an integer.

2. The driver of claim 1, wherein the timing controller comprises a display signal input terminal, a first sensing signal input terminal and a display data output terminal; the timing controller is configured to generate an initial display driving signal based on a display signal received through the display signal input terminal and a sensing signal received through the first sensing signal input terminal, and output the initial display driving signal through the display data output terminal;

the source driver comprises an initial display driving signal input terminal, a sensing signal output terminal, a second sensing signal input terminal, a third sensing signal input terminal and a source driving signal output terminal; the third sensing signal input terminal is configured to receive a sensing signal provided from a detection circuit corresponding to the source driver; and the N source drivers sequentially transmit the sensing signals received by the N source drivers to the first sensing signal input terminal of the timing controller, and wherein the N source drivers are cascaded by coupling the sensing signal output terminal of the n-th source driver to the second sensing signal input terminal of the (n+1)-th source driver, and electrically coupling the sensing signal output terminal of a last one of the N source drivers to the first sensing signal input terminal of the timing controller.

3. The driver of claim 2, wherein the source driver comprises a source driving sub-circuit, a digital-to-analog conversion sub-circuit and an analog-to-digital conversion sub-circuit, an input terminal of the source driving sub-circuit is configured as the initial display driving signal input terminal of the source driver, and a first output terminal of the source driving sub-circuit is electrically coupled to an input terminal of the digital-to-analog conversion sub-circuit; the source driving sub-circuit is configured to convert a received initial display driving signal into a source driving signal in digital form and output the source driving signal in digital form through the first output terminal of the source driving sub-circuit to the digital-to-analog conversion sub-circuit;

an output terminal of the digital-to-analog conversion sub-circuit is configured as the source driving signal output terminal of the source driver, and the digital-to-analog conversion sub-circuit is configured to convert the received source driving signal in digital form into a source driving signal in analog form and output the source driving signal in analog form;

an input terminal of the analog-to-digital conversion sub-circuit is configured as the third sensing signal input terminal of the source driver, and an output terminal of the analog-to-digital conversion sub-circuit is configured as the sensing signal output terminal of the source driver; the analog-to-digital conversion sub-circuit is configured to convert a received sensing signal in analog form into a sensing signal in digital form and output the sensing signal in digital form in a first predetermined timing.

4. The driver of claim 3, wherein the source driver further comprises a clock sub-circuit, the timing controller further comprises a clock signal output terminal, and the timing controller is further configured to sequentially output clock control signals to the clock sub-circuits of the N source drivers in a second predetermined timing;

an input terminal of the clock sub-circuit is electrically coupled to the clock signal output terminal of the timing controller, and an output terminal of the clock sub-circuit is coupled to a control terminal of the analog-to-digital conversion sub-circuit belonging to the same source driver as the clock sub-circuit; the clock sub-circuit is configured to output, upon receipt of a clock control signal from the timing controller, a clock signal to the control terminal of the analog-to-digital conversion sub-circuit belonging to the same source driver as the clock sub-circuit;

and the analog-to-digital conversion sub-circuit is configured to output the sensing signal in digital form based on the received clock signal.

5. The driver of claim 3, wherein the source driver further comprises a clock sub-circuit and the timing controller further comprises a clock input terminal, the source driving sub-circuit is further configured to generate a timing control signal, and output the timing control signal to a first input terminal of the clock sub-circuit belonging to the same source driver as the source driving sub-circuit and a control terminal of the analog-to-digital conversion sub-circuit belonging to the same source driver as the source driving sub-circuit, respectively, through a second output terminal of the source driving sub-circuit; and the clock sub-circuit is configured to generate a clock signal based on the timing control signal;

the analog-to-digital conversion sub-circuit is configured to output the sensing signal in digital form upon receipt of the timing control signal;

wherein the N source drivers are cascaded by electrically coupling an output terminal of the clock sub-circuit of the n-th source driver to a second input terminal of the clock sub-circuit of the (n+1)-th source driver, and electrically coupling an output terminal of the clock sub-circuit of the last one of the N source drivers to the clock input terminal of the timing controller, so as to sequentially transmit the clock signals of the N source drivers to the timing controller; and after a first frame of image is displayed, the timing controller is configured to transmit the initial display driving signal to a corresponding source driver upon receipt of the clock signal.

6. The driver of claim 4, wherein each of the clock control signal and the clock signal comprises a plurality of pairs of differential signals.

7. The driver of claim 5, wherein each of the timing control signal and the dock signal comprises a plurality of pairs of differential signals.

8. The driver of claim 1, wherein the sensing signal comprises at least one pair of differential signals.

9. A display apparatus comprising a display panel and a driver, the display panel comprising a plurality of data lines and a plurality of detection circuits, wherein the driver is the driver of claim 1, and the plurality of detection circuits are in one-to-one correspondence with the N source drivers, an output terminal of a detection circuit is electrically coupled to a third sensing signal input terminal of a source driver corresponding to the detection circuit, and a source driving signal output terminal of the source driver is electrically coupled to a corresponding data line.

10. A method for generating a source driving signal using a driver, the driver being configured to drive a display panel and comprising a timing controller and N source drivers that are cascaded, N being an integer equal to or larger than 2, the method comprising:

receiving, by the N source drivers, sensing signals obtained by detecting characteristics of pixel units in the display panel, respectively; and transmitting the received sensing signals to the timing controller, respectively, wherein an n-th source driver of the N source drivers is configured to transmit the sensing signal received by the n-th source driver to the timing controller through all source drivers of the N source drivers after the n-th source driver as a signal transmission channel, where $1 \leq n < N$ and n is an integer.

11. The method of claim 10, further comprising:

generating, by the timing controller, an initial display driving signal based on a display signal and a sensing signal received by the timing controller, and outputting the initial display driving signal to a source driver from which the sensing signal is transmitted; and generating, by the source driver, a source driving signal based on the initial display driving signal received by the source driver.

12. The method of claim 10, wherein the transmitting the received sensing signals to the timing controller, respectively comprises:

outputting, by the timing controller, clock control signals to the N source drivers sequentially in a predetermined timing, such that the n-th source driver of the N source drivers, which receives the clock control signal, transmits the received sensing signal to the timing controller according to the predetermined timing.

13. The method of claim 10, further comprising:

controlling the n-th source driver to transmit a clock signal generated by the n-th source driver to the timing controller through all source drivers of the N source drivers after the n-th source driver as a signal transmission channel; and transmitting, by the timing controller after receiving the clock signal, an initial display driving signal to the n-th source driver.

14. The method of claim 12, further comprising:

controlling a last one of the N source drivers to transmit the received sensing signal directly to the timing controller according to the predetermined timing.

15. The method of claim 13, further comprising:

controlling a last one of the N source drivers to transmit a clock signal generated by the last one of the N source drivers directly to the timing controller.

* * * * *